United States Patent [19]

Nobbs

[11] 4,138,109

[45] Feb. 6, 1979

[54] RACKET AND THROAT PIECE THEREFOR

[76] Inventor: John W. Nobbs, Alloways, Ewhurst, Surrey, England

[21] Appl. No.: 776,834

[22] Filed: Mar. 14, 1977

[30] Foreign Application Priority Data

Mar. 17, 1976 [GB] United Kingdom ..... 10631/76

[51] Int. Cl.[2] ..... A63B 49/00

[52] U.S. Cl. ..... 273/73 G

[58] Field of Search ..... 273/73 R, 73 C, 73 D, 273/73 F, 73 G, 73 H, 73 E

[56] References Cited

U.S. PATENT DOCUMENTS

| | | | |
|---|---|---|---|
| 1,585,416 | 5/1926 | Rastetter | 273/73 G |
| 3,612,526 | 10/1971 | Brull | 273/73 G X |
| 3,664,668 | 5/1972 | Held | 273/73 D X |
| 3,702,701 | 11/1972 | Vaughn et al. | 273/73 G X |
| 3,884,467 | 5/1975 | Sommer | 273/73 D |
| 3,908,995 | 9/1975 | Portz | 273/73 G |
| 3,958,805 | 5/1976 | Cooper | 273/73 G |
| 3,990,701 | 11/1976 | Kim | 273/73 G X |
| 4,013,290 | 3/1977 | Stevens | 273/73 E |
| 4,046,377 | 9/1977 | Khazzam | 273/73 G |

FOREIGN PATENT DOCUMENTS

| | | | |
|---|---|---|---|
| 1196771 | 5/1959 | France | 273/73 D |
| 1582080 | 8/1969 | France | 273/73 D |
| 2049750 | 5/1972 | Fed. Rep. of Germany | 273/73 G |
| 2224316 | 11/1973 | Fed. Rep. of Germany | 273/73 H |
| 14798 | 7/1904 | United Kingdom | 273/73 H |

*Primary Examiner*—Richard J. Apley

*Attorney, Agent, or Firm*—William Anthony Drucker

[57] ABSTRACT

The game racket comprises a frame made from extruded metal bent symmetrically to form a substantially circular or elliptical frame portion and a pair of symmetrical shafts. In the region of the throat where the frame portion merges with the shafts there is provided an extruded metal throat-piece of which one wall completes in combination with said frame a striking area. The throat-piece has side walls formed complementary to the shafts. Holes pass through the throat-piece walls and align with holes provided in the frame and shafts and serve to receive the racket strings which draw the shafts towards the throat-piece and hold the latter under compression at the throat region.

10 Claims, 3 Drawing Figures

RACKET AND THROAT PIECE THEREFOR

BACKGROUND TO THE INVENTION

This invention relates to a racket for use in tennis, squash, badminton, racketball and other such games in which a member is shaped symmetrically to form a frame portion integral with a pair of symmetrical shafts to which a handle is secured. In one known construction the striking area is completed by a metal throat piece (yoke) secured to the shafts by rivets. The racket strings pass through apertures in the wall of the throat piece, which wall effects completion of the striking area, and hold the throat piece in tension. Such rackets have been known to break at the throat or at the fixings to the frame due to the very high stresses occurring throughout the throat-piece which effects completion of the striking area.

SUMMARY OF INVENTION

According to the present invention I provide a game racket frame comprising a first metal member bent symmetrically to form a substantially circular or elliptical frame portion and a pair of symmetrical shafts, a second metal member serving as a throat-piece of which one wall completes in combination with said frame portion a striking area, said throat-piece having side walls having outer surfaces formed complementary to said symmetrical shafts which they engage, said one wall, said side walls, said frame portion and said shafts in the region of the throat-piece having apertures therein for receiving strings, wherein when said racket is strung the throat piece is held in compression by said strings between said shafts.

Since the throat-piece is held in compression by the strings it is not necessary to provide rivets to secure the throat-piece to the shafts. Furthermore, although the throat-piece is not flexible, in the common usage of that word, torsional rotation of the frame in the area of the throat-piece can take place because the throat-piece is secured in position by the racket strings which pass through it and the frame.

By constructing the racket so that the throat-piece is under compression it is not necessary to make the throat-piece so robust as in the known arrangement.

Figure 1:
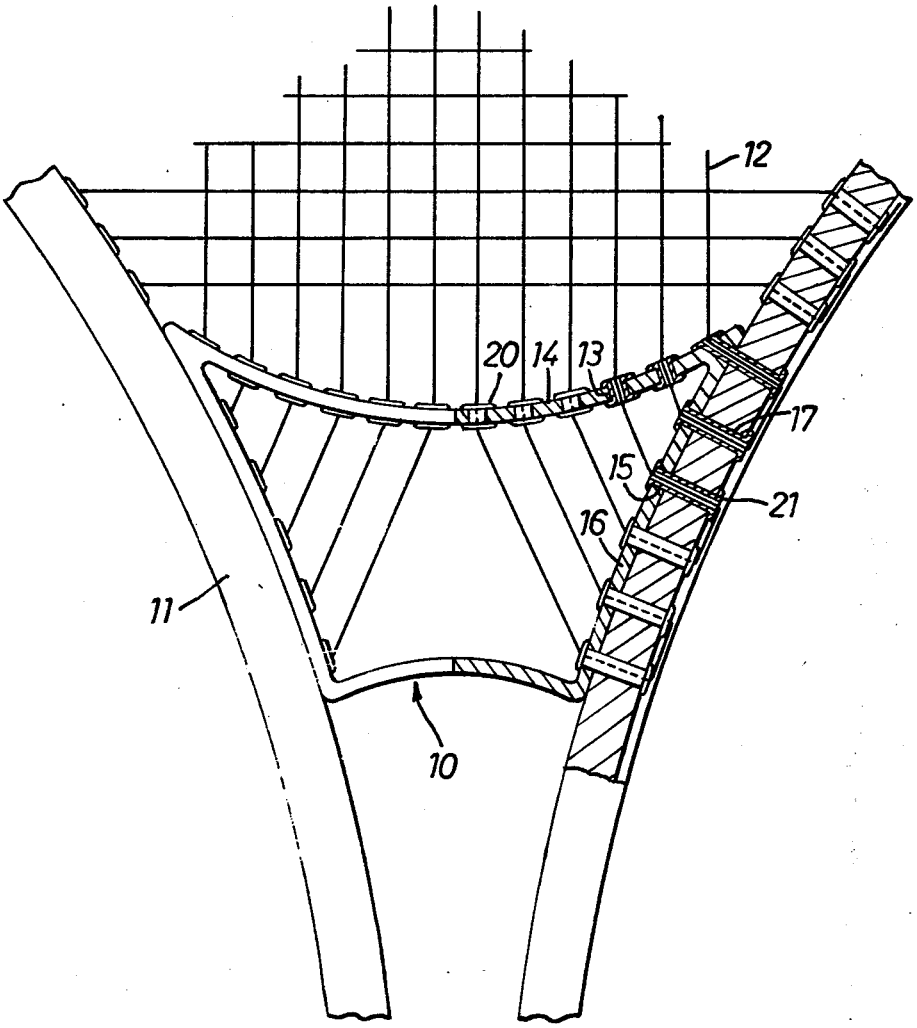
Figure 2:
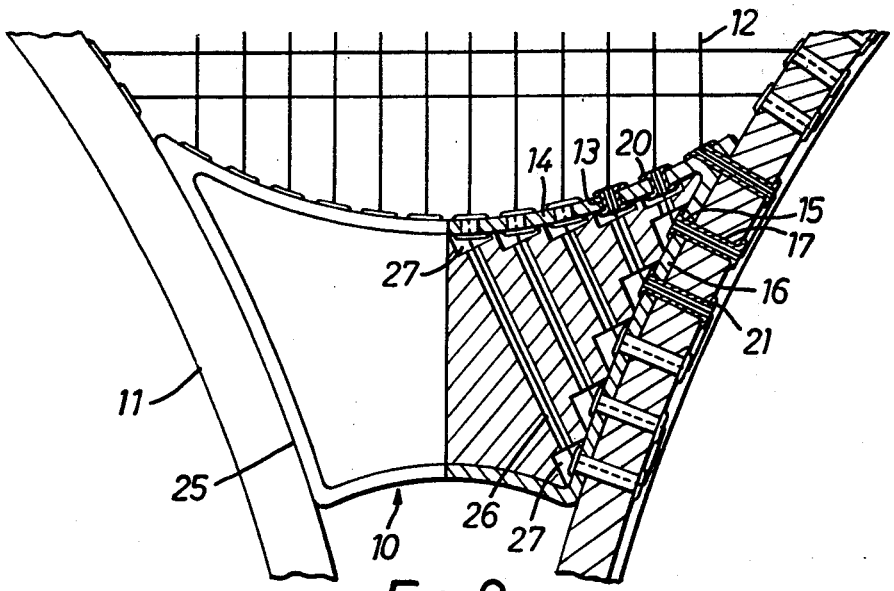
Figure 3:
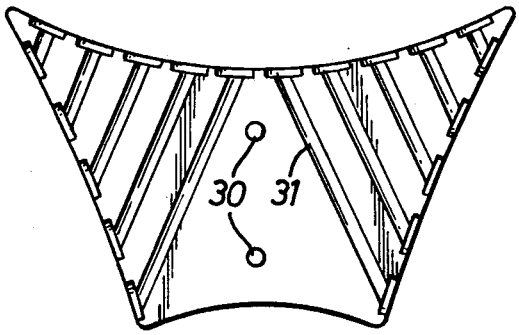

The invention will now be described by way of example with reference to the accompanying drawings in which:

FIG. 1 shows a part sectional view in the region of the throat-piece including parts of the frame portion and shafts, FIG. 2 shows a view in the region of the throat-piece having an insert, the left hand half being shown in full and the right hand half in cross-section in the plane of the strings, and FIG. 3 is an elevation of one half of a two-piece insert for the throat-piece.

In the example shown in FIG. 1, a hollow frame-like throat-piece 10, formed as a single continuous solid strip from a hollow extrusion, is located between the shafts 11 and is held in position by the strings 12 which pass through apertures 13 in the wall 14, through apertures 15 in the side walls 16 formed complementary to said shafts, and through apertures 17 in the shafts coincidentally formed with said apertures 15.

Plastic grommets 20 are provided in the apertures 13 and serve to protect the strings from sharp edges. The coincident apertures 15 and 17 are also lined with grommets 21. For added protection the grommets are provided with flanges at both ends, one end being upset by heating after the grommet has been located in an aperture. Since these grommets will be made of a flexible material, e.g. unfilled Nylon, torsional rotation around the throat area of the racket will not be impaired or will be impaired to a degree which is not material. The grommets passing through the racket frame and throat-piece may be integrally formed with a strip which lies along a groove which is formed at the outside edge of the frame portion. The grommets may instead be formed of metal turned over at each end in a similar manner to metal eyelets. Protection for the strings may be made by other methods not employing grommets passing through the racket frame and throat-piece.

In practice before stringing, the throat-piece will be held in the approximate position it will assume after stringing by a convenient method. A method of holding the throat-piece in position before stringing is to insert through the frame and side of the throat-piece two or more of the grommets.

The throat-piece is preferably and most conveniently made from an aluminium extrusion but other suitable alloys may be used, including steel. The throat-piece may be cast and/or machined. The racket frame may be made of alloys of light metal (aluminium), steel or other suitable materials.

In the modified form of the invention as shown in FIG. 2 an insert 25 is provided within the central area of throat-piece racket, other items being similarly formed as in the previous example and referenced with the same numerals as in FIG. 1, and is retained by the strings passing through apertures 26 through the insert. The apertures 26 are provided at each end with counterbores 27 to accommodate the flanges of the grommets. By providing counter bores the grommets 20 may have flanges only on the insert side, no heat fusing being necessary at the striking region side. Since the flanges of the grommets 20 are held by the throat-piece wall 14 the grommets cannot ride up the strings.

The insert conforms to the shape of the area defined by the inside surfaces of the throat-piece. The principal effect of providing such an insert is a strengthening of the throat-piece when it is under compression after stringing and in play. The strengthening enables the thickness of the material of the throat-piece to be less thick than it might otherwise have been. The insert also serves to hide the strings passing through the throat-piece and to provide an area on which advertising or decorative material can be placed. Examples of the material of which the insert may be made are metals, plastics, wood, vulcanised fibre or combinations of these materials.

The insert is made in two halves stuck together with an adhesive. The halves may be identical or alternatively may be formed in pairs having locating spigots 30 and corresponding apertures (not shown) to receive them. FIG. 3 shows one half of the two-piece insert in which semi-cylindrical grooves 31 have been formed, the ends being enlarged to provide recesses to accommodate the grommet flanges (see the counterbores in FIG. 2). Moulding avoids the necessity of drilling and moulding the insert in halves enables the die to be simplified. If desired the grommets lining the apertures in the wall completing the striking area may be replaced by a sleeve formed integrally with the insert. Where the insert is formed in two identical pieces the sleeve half is semi-cylindrical.

The insert may be formed as a one-piece moulding. In this example the grommets are located in position by inserting them from the exterior of the throat-piece after the latter has been placed in position within the throat-piece. The grommets will extend into the counterbores and are not upset in this case.

The weight of the throat-piece and/or the insert may be varied for the purpose of selecting the weight and balance of a racket. The control of weight is therefore not limited to the selected weight for the frame or handle.

I claim:

1. A game racket comprising:

(a) a first member shaped symmetrically to form a substantially circular or elliptical frame portion and a pair of symmetrical shafts, (b) a hollow frame-like second member of metal serving as a throat-piece of which one wall completes in combination with said frame portion a striking area, (c) said throat-piece having side walls having outer surfaces formed complementary to said symmetrical shafts which they engage, (d) said one wall, said side walls, said frame portion, and said shafts in the region of the throat-piece having apertures therein, the apertures in said side walls being in alignment with the apertures in the shafts, and (e) strings comprising longitudinal strings and transverse strings extending across said striking area, the central longitudinal strings passing through said apertures in said one wall, side walls and said shafts to hold said throat-piece in compression between said shafts, said strings in the throat area being the sole means of retaining the throat-piece in place.

2. A game racket frame according to claim 1, in which the second member is formed from a hollow extrusion.

3. A game racket frame according to claim 1, wherein within the walls of the throat-piece there is provided an insert conforming to the area defined by the inner surfaces of the walls, said insert having apertures therein for receiving the racket strings extending from the apertures in the side walls to the apertures in said one wall.

4. A game racket according to claim 3, wherein the insert is made of a plastics material.

5. A game racket frame according to claim 4, wherein the insert is formed by two moulded halves cemented together.

6. A game racket frame according to claim 5, wherein the insert halves are formed in pairs having locating spigots and corresponding apertures to receive them.

7. A game racket frame according to claim 3 wherein the ends of the apertures in the insert are enlarged to accommodate the flanges of grommets when the racket is assembled.

8. A game racket according to claim 1, wherein grommets are provided through the aligned holes in the side walls and said shafts, the ends of the grommets being turned over to form flanges.

9. A game racket according to claim 8, wherein an insert is provided within the walls of the throat-piece to support the latter, the insert conforming to the area defined by the inner surfaces of the walls of the throat-piece, said insert having apertures therein through which pass said strings to hold the insert under compression and to locate the latter within the throat-piece.

10. A game racket according to claim 9, wherein the ends of the apertures in the insert are enlarged to receive the flanges of grommets which protect the strings in the region of the apertures in the walls of the throat-piece.

* * * * *